United States Patent [19]

Scholz

[11] 4,047,550

[45] Sept. 13, 1977

[54] PACKAGING WRAPPER

[75] Inventor: William A. Scholz, Ontario, Calif.

[73] Assignee: Standun, Inc., Compton, Calif.

[21] Appl. No.: 660,421

[22] Filed: Feb. 23, 1976

[51] Int. Cl.[2] ..... B65D 65/02

[52] U.S. Cl. ..... 150/52 R

[58] Field of Search ..... 229/43; 150/52 R

[56] References Cited

U.S. PATENT DOCUMENTS

| | | | |
|---|---|---|---|
| 2,028,454 | 1/1936 | Johnson | 150/52 R |
| 2,035,384 | 3/1936 | Hinchliff | 150/52 R |
| 2,336,950 | 12/1943 | Moss | 150/52 R X |
| 2,486,320 | 10/1949 | Ost | 150/52 R X |
| 2,490,451 | 12/1949 | Magio | 150/52 R X |
| 2,690,250 | 12/1949 | Boener | 150/52 R |
| 2,741,287 | 4/1956 | Michaud | 150/52 R |
| 2,812,900 | 11/1957 | Matthews | 150/52 R X |
| 2,845,735 | 8/1958 | Werner | 150/52 R |
| 3,603,369 | 9/1971 | Scholz | 150/52 R |
| 3,766,954 | 10/1973 | Gentellalli | 150/52 E |

*Primary Examiner*—Davis T. Moorhead

*Attorney, Agent, or Firm*—Mahoney, Schick & Cislo

[57] ABSTRACT

A packaging wrapper having a stretchable net-like wrapper member conforming to a hollow, substantially sheath-like configuration having an article receiving opening bounded by an edge of the member to which is secured an elastic cord for yieldably contracting the edge circumferentially in such a way that the wrapper is adapted to be placed about and resiliently grip an article to be packaged. One disclosed embodiment is a cap-like cover for an article container, such as a produce box. Another disclosed embodiment has a tubular configuration with open ends for receiving an article, such as a produce article, to be packaged, and an elastic cord secured to at least one open end of the member for contracting the end about the article.

1 Claim, 8 Drawing Figures

(A)
(B)
14
10
12

20
32
16
30
3
18

20
16
30
24
22
18
32

16
28
24
22
26

24B
16B
20B
26B
24B 16A
20A
22A
24A
26A 24C
26C
16C
20C
24C
26C

PACKAGING WRAPPER

BACKGROUND OF THE INVENTION

1. Field of the Invention

This invention relates generally to the article packaging field and more particularly to a novel net-like packaging wrapper for produce and other articles.

2. Prior Art

The packaging art is replete with a vast assortment of packaging wrappers and the like for produce and other articles. The present invention is concerned primarily with produce packaging and will be described in this context. It will become evident as the description proceeds, however, that the packaging wrapper of the invention may be used for purposes other than packaging produce.

Some types of fresh produce, such as berries and the like, are frequently sold in open topped produce boxes while other produce article, such as celery, lettuce and the like, are not generally so packaged. Packaged wrappers, however, are often used for both boxed and unboxed produce. In the case of boxed produce, for example, a packaging wrapper in the form of a cap-like cover is often secured over the open tops of produce filled boxes, such as berry boxes. In the case of some unboxed produce, such as lettuce, grapes and the like, a packaging wrapper is often secured about the produce.

Produce packaging wrappers of this kind serve several purposes. In the case of boxed produce, for example, the wrapper keeps the contents in the boxes and prevents customers from removing produce articles from or adding articles to the boxes, as well as from handling the articles. In the case of the wrapped produce, such as lettuce and grapes, the wrapper retains the produce in a compact condition and shields the produce against direct contact with customer's hands. In both cases, the wrapper retains moisture in the produce to prolong its shelf life.

Produce packaging wrappers of this kind must satisfy certain requirements to be acceptable. For example, the wrappers must be sufficiently durable to withstand the handling to which they are subjected in storage, shipment, and sale. Further, the wrappers must have openings to assure proper ventilation of the produce, as required to preserve the freshness of the produce. The wrappers must also permit viewing of the produce and must be capable of conforming to the particular produce to be packaged.

A wide variety of such produce wrappers have been devised. As stated, a cap or cap-like cover is often used to cover the open tops of produce-filled boxes. Such caps have several shortcomings, among which are that individual caps are made to fit only one size box, that they frequently fall off or become detached, they do not accommodate varying or heaping amounts of contents, and involve the problem of reducing or eliminating visibility of the contents because of condensation or fogging of moisture on the caps. Transparent film packaging wrappers are often utilized. Such plastic films also have the shortcoming of visibility of the contents being reduced or eliminated by fogging or condensation of moisture on the plastic. The reduced visibility requires re-packing of boxes or baskets each time they are removed from a storage cooler or refrigerator for display.

One type of wrapper which is widely used for both boxed and unboxed produce, consists of a transparent plastic film having parallel rows of spaced slits wherein the slits in adjacent rows are staggered in a way which renders the film stretchable edgewise in a transverse direction of the slit rows. The prior art also contains a variety of stretchable net-like wrappers which are used for packaging and other purposes. A woman's hair net, for instance, is one example of such a net "wrapper." Another existing stretchable net-like wrapper, which is sometimes used to package candles, is fabricated from a net-like material produced by several different companies, such as Dupont Company which markets the material under the trade name VEXAR. The net-like wrapper made from this material, is generally of tubular form and, in this form, is ideally suited for candle packaging purposes. This net material is also made into bags by closing one end of the tube by a tie band, cardboard bottom wall, or the like.

The net material mentioned above will be described in more detail later. Suffice it to say here that the material possesses the unique ability to stretch edgewise in one direction to several times its unstretched dimension and to contract by elastic strain energy to its original dimension. The tubular wrapper referred to, for example, is stretchable to several times its unstretched diameter and, when released, contracts to its original unstretched diameter.

SUMMARY OF THE INVENTION

This invention provides a novel packaging wrapper, particularly for packaging produce, which embodies the stretchable net or net-like material just discussed. The wrapper comprises a wrapper member constructed of such material and conforming to a hollow sheath-like configuration having an article receiving opening bounded by an edge of the member. The wrapper member is stretchable edgewise to increase its dimension including the circumference and hence diameter of its opening.

Encircling this opening and attached to the surrounding edge of the wrapper member is an elastic cord. The unstretched circumferential length of this cord is less than a partially stretched circumferential length of the edge. Accordingly, enlargement of the opening by stretching of the wrapper member stretches the cord. When stretched, the cord provides a yieldable constricting force acting circumferentially of the opening.

One described embodiment of the invention is a cap or cover for a produce box or the like. In this embodiment, the elastic cord yieldably retains the edge of the wrapper member about its opening in gripping contact with the box below its rim to hold the wrapper or cover on the box.

The packaging wrapper of the present invention eliminates condensation or fogging, because it provides unlimited ventilation, thus insuring full visibility of the contents of the boxes and thus eliminating the time and labor involved in re-packing boxes on removal from cool storage for display. The package wrapper of the invention fits practically any size box, accommodates itself to varying amounts of box contents, such as heaped contents or leveled contents, and clings tightly to the box.

Other described embodiments of the invention are tubular sheath-like sleeves for containing celery stalks and other normally unboxed produce articles or the like. An elastic cord is secured to one or both open ends of the sleeve to contract the sleeve end or ends about the packaged article.

A feature of these described embodiments resides in the fact that the cord is attached to the net-like wrapper member by being threaded through openings in the net.

BRIEF DESCRIPTION OF THE DRAWINGS

FIG. 1A is an enlarged portion of net-like material of the kind referred to earlier, showing the material in its normal unstressed condition;

FIG. 1B is a view similar to FIG. 1 showing the material in a stretched condition;

DESCRIPTION OF THE PREFERRED EMBODIMENT

Figures 1, 2, 3, 4, 5, 6, 7:
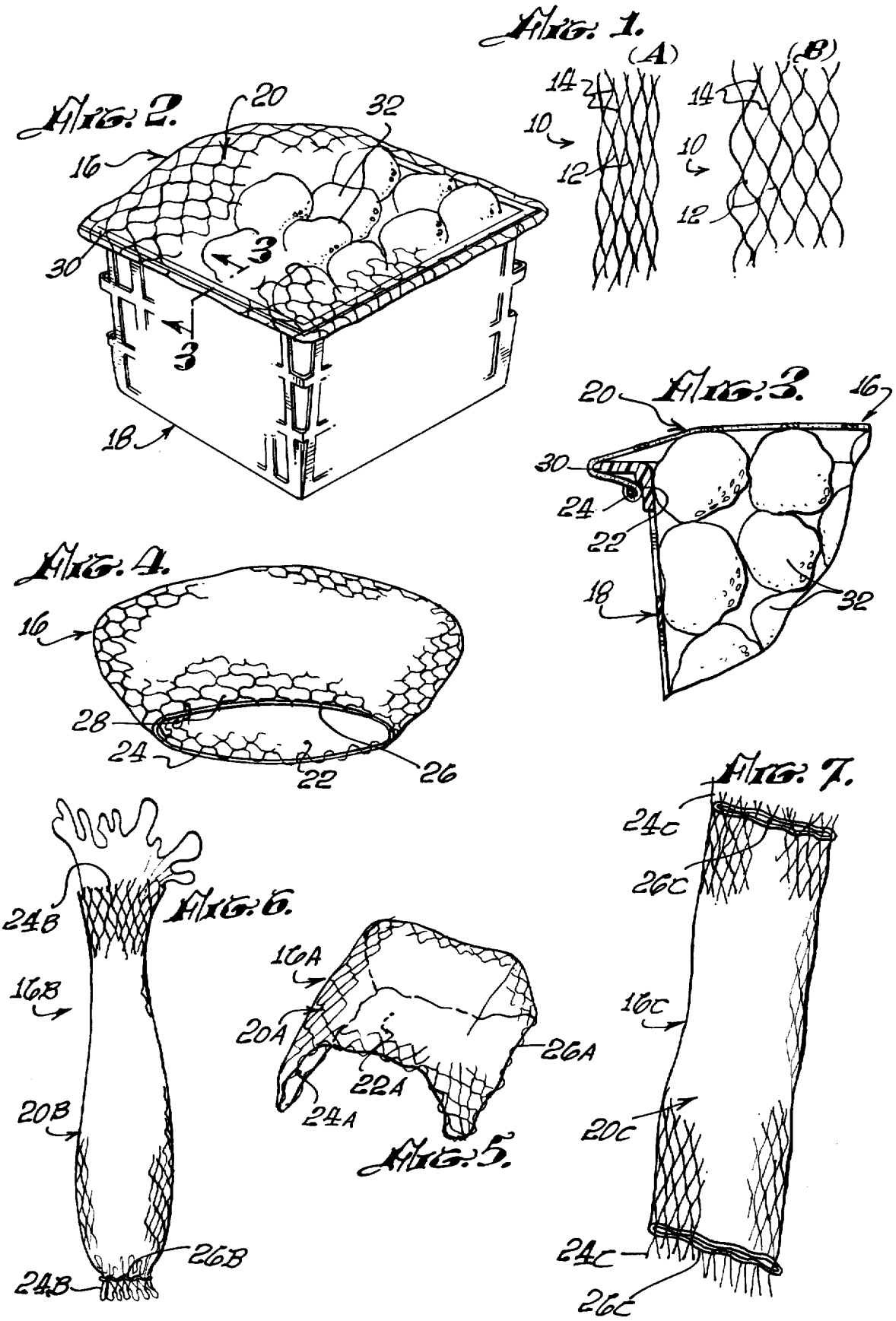
FIG. 2 is a perspective view of a packaging wrapper or cover installed on a produce box.
FIG. 3 is an enlarged section taken on line 3—3 in FIG. 2.
FIG. 4 is a perspective view of the wrapper.
FIG. 5 is a perspective view of a modified packaging wrapper for unboxed produce such as lettuce, grapes or the like showing the wrapper in a stretched condition.
FIGS. 6 and 7 illustrate further modified packaging wrappers for stalked produce, such as celery, asparagus and the like, the wrapper in FIG. 6 being shown in somewhat expanded condition.

Referring first to FIG. 1, there is illustrated an enlarged portion of net or net-like material 10 of the kind used in the present packaging wrapper. As noted earlier, this material is produced commercially by a number of companies, including the Dupont Company which markets the material under the trade name VEXAR. Since the material is conventional, it need be described only in sufficient detail to enable an understanding of the invention.

With this in mind, the material 10 comprises resiliently flexible strands 12 which extend in the same edgewise direction of the material, in generally parallel relation to one another. The adjacent strands are joined to one another at junctions 14 generally uniformly spaced along the strands. These junctions are staggered in such a way that the junctions between each pair of adjacent strands are located approximately midway between the junction of each strand of the pair and its other adjacent strand, such that the material resembles so-called expanded metal and is stretchable edgewise in a transverse direction of the strands 12.

The material 10 is prestressed to normally assume its contracted condition of FIG. 1A, wherein the strands 12 are relatively straight or linear and located in relatively close proximity to one another. The material is stretchable edgewise, in a transverse direction of the strands, to an expanded condition, such as that shown in FIG. 1B, wherein the strands are deflected laterally into the sinuous configuration shown. In this sinuous configuration, the strands store elastic strain energy for contracting the material to its condition of FIG. 1A, when the material is released.

Turning now to FIGS. 2–4 there is illustrated a packaging wrapper 16 according to the invention which, in this case, is a cap-like cover for a produce basket or box 18. Wrapper 16 comprises a stretchable wrapper member 20 consisting of a circular piece of the net or net-like material 10 conforming to a hollow generally sheath or cap-like configuration having an article receiving opening 22. This opening is bounded by the edge 24 of the member.

According to the present invention, an elastic cord 26 encircles the opening 22 and is secured to its boundary edge 24. Cord 26 is secured to the edge 24 by being threaded back and forth through the circumferential row of net openings 28 adjacent the edge and has its ends knotted or otherwise joined to one another to form a cord ring about the opening.

The strands 12 of the wrapper member 20 extend transverse to the boundary edge 24 throughout a major portion of this edge. Accordingly, the wrapper member is stretchable edgewise in a tranverse direction of the strands to enlarge its dimensions including the circumferential length of its edge 24 and hence the diameter of its opening 22. The unstretched circumferential length of the elastic cord 26 is less than a partially stretched circumferential length of the edge 24. Accordingly, stretching of the wrapper member stretches the cord which then exerts a yieldable constricting force circumferentially of the opening 22 tending to constrict the latter.

As noted above, the packaging wrapper 16 is adapted to serve as a cover for a produce box 18. In this use, the wrapper is sized so that it must be stretched for placement over the open top of the box. The elastic cord 26 stretches during this stretching of the wrapper, such that when the wrapper is on the box, the cord constricts the wrapper edge 24 about the box to yieldably retain the wrapper in position. In the event the box has a lip or shoulder 30 about its rim, as shown, the cord constricts the wrapper edge under the rim to firmly hold the wrapper on the box.

This form of wrapper is designed to retain produce articles 32 in the box 18 and inhibit customers from removing or adding articles from or to the box as well as handling the articles. The net openings in the wrapper provide ventilation for the produce. It will be understood, of course, that the wrapper may be used for other purposes.

The modified packaging wrapper 16A of FIG. 5 is similar to that of FIGS. 2–4 but is adapted for packaging relatively compact, unboxed produce items such as a head of lettuce, a bunch of grapes, or the like. This modified wrapper has a stretchable wrapper member 20A of the material 10 conforming to a hollow configuration with an article receiving opening 22A through which the article to be packaged may be inserted into the wrapper. Opening 22A is bounded by an edge 24A of the wrapper member to which is secured, by extension back and forth through the adjacent net openings, an elastic cord 26A. The unstretched length of this cord is such that it constricts the opening 22A almost completely, or at least to a diameter substantially less than the cross-sectional dimension of the packaged article. The illustrated wrapper member 20A comprises a generally square piece of the material 10, although the member may have some other polygonal shape. Preferably, the strands 12 of the wrapper member extend diagonally of the member so as to be transverse to the edge 24A of the member throughout vertically its full length and thereby permit stretching and contraction of the edge.

The wrapper 16A is designed to envelope the entire packaged article and thereby contain the article in a compact mass and shield it to some degree against direct contact with the hands of persons handling the package as well as provide adequate ventilation for the packaged article. As noted the elastic cord 26A tends to almost completely close the wrapper opening 22A and thereby retains the wrapper on the packaged article.

The modified packaging wrappers 16B and 16C of FIGS. 6 and 7 are designed for packaging stalked produce, such as celery, asparagus, and the like. These wrappers have tube or sleeve-like wrapper members 20B, 20C of the net or net-like material 10. The ends of the wrapper members are open and bounded by end edges 24B, 24C of the members, and the strands 12 of the members extend lengthwise of the latter and hence transverse to the end edges. The wrapper members are thus stretchable and contractable circumferentially to accommodate packaged produce of various cross-sections with or without the ends of the produce extending through the open ends of the members, as shown. The wrapper members contract by elastic strain energy about the packaged articles to maintain the latter in a compact condition.

The wrapper 16B of FIG. 5 has an elastic cord 26B secured to one end edge 24B only. Wrapper 16C has an elastic cord 26C secured to each end edge. These cords constrict their corresponding package ends about the packaged articles, if the articles extend through the ends as in FIG. 6, or may be sized to almost completely close the ends if the produce to be packaged does not extend through the ends.

I claim:

1. A packaging wrapper and article container combination comprising: a relatively rigid article container having an open side, such as a produce box; said article container being adapted to be filled with a multiplicity of relatively small articles; a stretchable net-like wrapper member conforming substantially to a hollow cap-like configuration and having a container receiving opening bounded by an edge of said member; said wrapper member comprising a multiplicity of flexible, non-absorbant, extruded monofilament plastic strands throughout, which are preformed to normally assume a generally rectilinear configuration and extend in the same edgewise direction of said member and transverse to said member edge throughout said edge; and the adjacent strands being joined to one another at relatively widely spaced junctions generally uniformly spaced along the strands with the junctions of each pair of adjacent strands located approximately midway between the junctions of each strand of said pair and its other adjacent strand; relatively small cross-sections of said strands, as compared to said relatively widely spaced junctions, defining adjacent offset circumferential rows of relatively large net openings encircling said container receiving opening and throughout said wrapper member, whereby said wrapper member is stretchable edgewise in a transverse direction of said strands to enlarge the dimensions of said member including the circumferential length of said edge in a manner which deflects said strands laterally into a sinuous configuration as permitted by said relatively large net openings wherein the strands store elastic strain energy for contracting said wrapper member in said transverse edgewise direction when the wrapper member is released; an elastic cord encircling said container opening in and secured to said edge of said wrapper member and having an unstretched circumferential length spaced less than a stretched circumferential length of said edge, said securement of said elastic cord to said edge of said wrapper member being substantially solely by said elastic cord being threaded through at least one row of said net openings adjacent said container receiving opening over and under said strands encircling said container receiving opening, whereby said elastic cord and said edge of said wrapper member are substantially independently stretchable except for said threaded securement; said wrapper member being positioned over said container open side with said independently stretchable wrapper member edge and threaded elastic cord encircling and stretchably gripping said container about its open side for retaining said multiplicity of relatively small articles in said container.

* * * * *